US008066039B2

(12) United States Patent
Arvin

(10) Patent No.: US 8,066,039 B2
(45) Date of Patent: Nov. 29, 2011

(54) RAIL END FORMER FOR CABINET DOORS

(76) Inventor: Kevin J. Arvin, Jamestown, NC (US)

( * ) Notice: Subject to any disclaimer, the term of this patent is extended or adjusted under 35 U.S.C. 154(b) by 163 days.

(21) Appl. No.: 12/543,555

(22) Filed: Aug. 19, 2009

(65) Prior Publication Data

US 2010/0043923 A1 Feb. 25, 2010

Related U.S. Application Data

(60) Provisional application No. 61/090,265, filed on Aug. 20, 2008.

(51) Int. Cl.
*B27M 1/08* (2006.01)
*B27C 5/00* (2006.01)

(52) U.S. Cl. ..... 144/3.1; 144/135.2; 83/713; 83/422

(58) Field of Classification Search ..... 144/134.1, 144/135.2, 135.3, 39, 1.1, 3.1, 2.1; 83/409, 83/422, 713
See application file for complete search history.

(56) References Cited

U.S. PATENT DOCUMENTS

| | | | | |
|---|---|---|---|---|
| 1,959,241 | A | 5/1934 | Kelley | 90/21 |
| 3,008,501 | A | 11/1961 | Hammer | 144/1 |
| 4,655,268 | A | 4/1987 | Lundblom | 144/3 |
| 4,984,351 | A * | 1/1991 | Matsuyama et al. | 483/4 |
| 5,103,880 | A | 4/1992 | Rice et al. | 144/3 |
| 5,429,461 | A * | 7/1995 | Mukherjee et al. | 409/163 |
| 5,980,172 | A * | 11/1999 | Shoda | 409/203 |
| 6,193,048 | B1 * | 2/2001 | Keith | 198/346.1 |
| 6,817,392 | B2 | 11/2004 | Phillips | 144/39 |
| 7,093,628 | B2 | 8/2006 | Kelly et al. | 144/360 |
| 7,171,738 | B2 | 2/2007 | Dick et al. | 29/563 |
| 7,591,619 | B1 * | 9/2009 | Chang et al. | 409/212 |

* cited by examiner

*Primary Examiner* — Shelley Self
(74) *Attorney, Agent, or Firm* — MacCord Mason PLLC

(57) ABSTRACT

An apparatus cuts rail ends for cabinet doors. Infeed and outfeed carriages are reciprocally movable along spaced apart tracks, and a transverse carriage is reciprocally moveable between the tracks. An arbor between the tracks supports and rotates a cutter. Clamps on the carriages selectively clamp a workpiece, so a workpiece clamped to the infeed carriage is carried past the arbor to cut an end of the workpiece, transferred to the transverse carriage, carried a desired distance towards the outfeed carriage, clamped to the outfeed carriage, carried past the arbor again to cut a second end of the workpiece, and released.

13 Claims, 12 Drawing Sheets

RAIL END FORMER FOR CABINET DOORS

This application claims the benefit of provisional application 61/090,265, filed Aug. 20, 2008.

BACKGROUND OF THE INVENTION

Field of the Invention

The present invention relates to an apparatus and method for forming ends on the rails of cabinet doors. Cabinet doors conventionally are made of two vertical stiles which form outer, vertical parts of a frame, along with two rails which are the horizontal parts of the frame. A webbing board is placed between the two stiles and two rails as they are brought together. Very often, the stiles have profiled inner edges for decorative purposes, and so do the rails. The typical construction is for the stiles to extend the full vertical length of the doors and be squared off at the ends. The rails extend between the vertical stiles and so the end of the rails butt into and are fastened to the stiles. The rails, thus, must have ends that accommodate the machined profile on the inside face of the stile, as well as interleaving fingers that help make a secure joint with the stile. Thus, the ends of the rails must be very carefully formed to make a tight fit with the stile.

Also, it is important that the lengths of the rails be very carefully made. If one of the rails is longer than the other, the door is not square, leading to problems such as aesthetic issues, as well as issues of doors not closing, particularly inset doors.

SUMMARY OF THE INVENTION

The present invention fulfills one or more of these needs in the art by providing an apparatus for cutting rail ends for cabinet doors. A frame movably supports an infeed carriage, a transverse carriage and an outfeed carriage. The infeed carriage and outfeed carriage are reciprocally moveable along infeed and outfeed tracks that are spaced apart and substantially parallel to one another, and the transverse carriage is reciprocally moveable from the infeed track to the outfeed track. An arbor between the infeed track and the outfeed track supports and rotates a cutter. Clamps on the carriages selectively clamp a workpiece to the respective carriages. A workpiece can be clamped to the infeed carriage, carried along the infeed track past the arbor to cut an end of the workpiece, released from the infeed carriage and clamped by the transverse carriage, carried a desired distance towards the outfeed carriage, clamped to the outfeed carriage, carried along the outfeed track past the arbor to cut a second end of the workpiece, and released from the outfeed carriage.

Preferably, the frame supports the transverse carriage for motion of the clamp of the transverse carriage to a first location that is further from the outfeed track than the spacing of the outfeed track than the spacing of the infeed track and to a second location that is further from the infeed track than the spacing of the infeed track to the outfeed track. This enables the clamp of the transverse carriage to clamp a midportion of a workpiece that has a length greater than twice the distance from the infeed track to the arbor.

In one embodiment the frame supports a rotating ball-screw threaded shaft driven by a servo motor to move the transverse carriage reciprocally from the first location to the second location.

Desirably, each of the clamps grasps a workpiece from two opposing sides in the direction of motion of the infeed carriage.

In a preferred embodiment the transverse carriage lifts the workpiece from the infeed carriage, transports the workpiece at a height above the arbor and lowers the workpiece to the outfeed carriage. A cantilevered support can be made vertically movable on the transverse carriage by a sliding bearing mounting and a pneumatic cylinder.

A pressure shoe can be mounted over the arbor to hold the workpiece flat against the infeed and outfeed carriages as the workpiece is carried along the infeed track and outfeed track past the arbor.

The infeed track has an origin upstream of the arbor and the apparatus can further have an abutment between the infeed and outfeed tracks adjacent the origin of the infeed track for abutting placement of the end of a workpiece that is to be cut on the cutter on the infeed carriage. The outfeed track has a terminus downstream of the arbor and the apparatus can include a rake positioned at the terminus to push the work piece from the outfeed carriage.

The transverse carriage can have a cantilevered support holding a pneumatic ram which cooperates with a stop on the transverse carriage to clamp the work piece for transfer from the infeed carriage to the outfeed carriage The infeed carriage may have a table with a fence, with its clamp is made up of a plurality of clamping elements which ride in slots on the table of the infeed carriage, and a ram that commonly drives the elements to clamp the work piece against the fence.

Preferably, the clamps on the carriages are of a profile about one half of a height of an expected workpiece, so that at least instantaneously a workpiece can be simultaneously clamped to both the infeed carriage and the transverse carriage, or both the transverse carriage and the outfeed carriage.

The invention can also be considered as a method of cutting rail ends for cabinet doors including clamping a workpiece to an infeed carriage, carrying the workpiece along an infeed track past an arbor to cut an end of the workpiece, releasing the workpiece from the infeed carriage and clamping the workpiece to a transverse carriage, carrying the workpiece laterally of the infeed track a desired distance towards an outfeed carriage, releasing the workpiece from the transverse carriage and clamping the workpiece to the outfeed carriage, carrying the workpiece along an outfeed track past the arbor to cut a second end of the workpiece, and releasing the workpiece from the outfeed carriage.

Clamping the workpiece to a transverse carriage may include clamping a midportion of the workpiece at a position that is further from the outfeed track than the distance from the outfeed track to the infeed track.

Each of the acts of clamping may include grasping the workpiece from two opposing sides in the direction of motion of the infeed carriage.

Carrying the workpiece laterally of the infeed track a desired distance towards an outfeed carriage may include lifting the workpiece from the infeed carriage, transporting the workpiece at a height above the arbor and lowering the workpiece to the outfeed carriage. The acts of lifting and lowering may include actuating a pneumatic cylinder to drive a cantilevered support vertically along a sliding bearing mounting of the transverse carriage.

The method may include pressing on the workpiece to hold the workpiece flat against the infeed carriage as the workpiece is carried along the infeed track past the arbor.

Preferably, clamping a workpiece to the infeed carriage is preceded by positioning the workpiece against an abutment between the infeed and outfeed tracks upstream of the arbor.

Releasing the workpiece from the outfeed carriage may be followed by pushing the work piece from the outfeed carriage.

Carrying the workpiece laterally of the infeed track a desired distance towards an outfeed carriage preferably includes actuating a servo motor to rotate a ball-screw threaded shaft to move the transverse carriage from the infeed track to the outfeed track.

Clamping the workpiece to a transverse carriage may include actuating a pneumatic ram on a cantilevered support on the transverse carriage against a stop on the transverse carriage to clamp the work piece for transfer from the infeed carriage to the outfeed carriage.

Clamping a workpiece to an infeed carriage may include commonly driving a series of clamping elements in slots on a table of the infeed carriage to clamp the work piece against a fence.

Desirably, releasing the workpiece from the infeed carriage and clamping the workpiece to the transverse carriage occur substantially simultaneously as the clamps on the carriages are of a profile about one half of a height of an expected workpiece, so that at least instantaneously a workpiece can be simultaneously clamped to both the infeed carriage and the transverse carriage.

Apparatus and methods according to the present invention provide an infeed carriage that allows a work piece of wood (a length of stock material) destined to become a rail to be placed onto the infeed carriage by a worker. An inside end of the work piece is positioned at a known longitudinal point by being abutted to a vertical plate. The work piece is clamped to the infeed carriage by a clamp carried on the infeed carriage. Then, the infeed carriage travels within the machine, so that the positioned end of the work piece encounters a high speed cutter rotated on an arbor that is located between the infeed and outfeed carriages and has a desired profile. Typically, the cutter is made with diamond bits. At the end of the travel on the infeed carriage, the work piece has the one positioned end machined with the desired profile, since that end encounters the cutter during the infeed motion.

An overhead transverse gripper/clamp then descends and clamps the work piece. The clamps of the infeed carriage open, so that the work piece can be raised by the gripper, and transported by a predetermined distance in the direction of the already cut end of the work piece. Then, the gripper clamp descends to an outfeed carriage configured much like the infeed carriage. A clamp on the outfeed carriage clamps the work piece. The overhead gripper/clamp releases its grip on the work piece and returns to the position where it is available to clamp the next work piece from the infeed carriage. The outfeed carriage carries the workpiece past the arbor, this time with the other end exposed to the machining of the cutter on the arbor. In an end position of travel of the outfeed carriage, the clamp is opened and an overhead rake pushes the work piece off of the outfeed carriage and off of the machine. A conveyor or other device can be positioned to receive the work piece from the machine.

At this point the work piece has had its two ends cut and profiled. The length of the cut work piece can be carefully controlled by the controlled transverse movement of the transverse gripper carriage, which moves from the infeed carriage to the outfeed carriage. The distance of that motion determines the positioning of the work piece on the outfeed carriage which, in turn, determines the position of the second of the two cuts on the ends of the work piece and the length of the finished work piece. The result is a finished rail having the required length and profile.

It is desirable is for the gripper clamp on the transverse carriage to be able to grip the center of the work piece (i.e. the center of its intended final length) and for the amount of travel from the infeed carriage to the center line of the machine to be the same as from the center line to outfeed carriage. With this arrangement, the gripper clamp carries the work piece balanced, with equal amounts of the work piece extending from the two sides of the purchase of the gripper on the work piece. This reduces any tendency to droop to one side or the other and helps maintain control. This is particularly important if the gripper has only a narrow purchase on the work piece. The purchase is preferably narrow because at two points in time the work piece also maybe simultaneously being gripped by the infeed and outfeed carriages, respectively, at what may be the same point along the length of the work piece.

Enabling the two clamps that oppose each other (i.e. the gripper clamp on the transverse carriage and the clamp on either of the infeed or outfeed carriages) to be at the same point on the work piece results in the ability to work with shorter work pieces, even as short as three inches in length. However, each gripper then has a purchase on only one half of the thickness of the work piece. By having the gripper clamp grasp the center of the work piece and have a balanced load, the disadvantage of the reduced purchase by the clamp of the transverse carriage is overcome.

The various carriages and clamps can be moved by pneumatics, hydraulics, or other known mechanical motion devices under the control of a program controller that feeds to them control signals to actuate at selected times for selected rates of speed and distance. The positioning of transverse gripper clamp by the transverse carriage is determined by the desired length of the machined work piece, which is information which can be supplied to the program controller by an operator or through other production control data carriers.

Preferably, the transfer moving gripper clamp travels on a rotating ball-screw threaded shaft, in order to provide precision position, driven by a servo motor. But, stepper and other control motors can also be used.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

The following description is illustrative of one embodiment of the invention. Those of ordinary skill will understand that variations are possible within the scope of the invention, particularly alternate mechanical configurations that give the same functional result.

Figure 1:
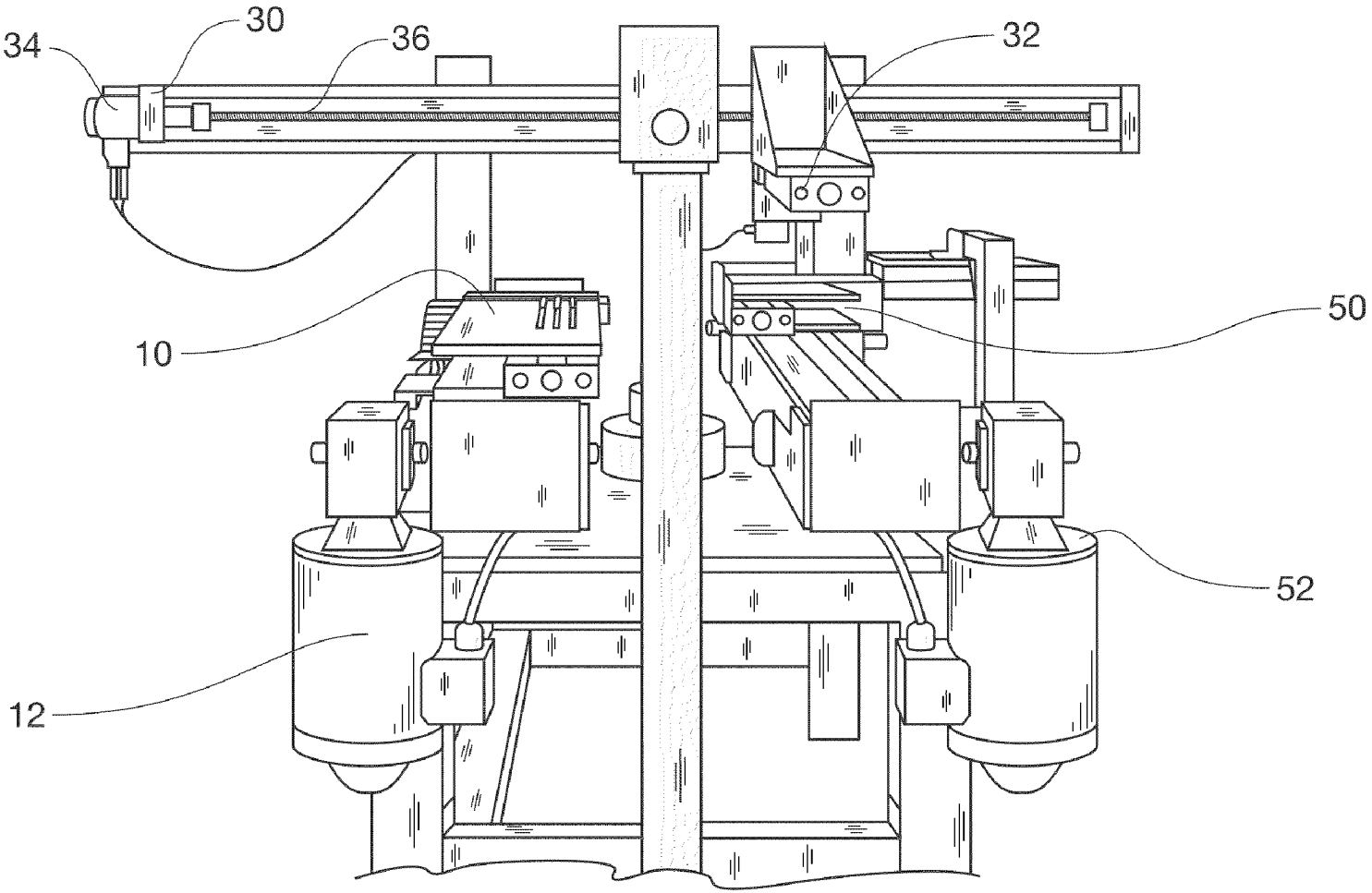
FIG. 1 and FIG. 1*a* both show end perspective views of the apparatus in accordance with the invention.
Figure 1A:
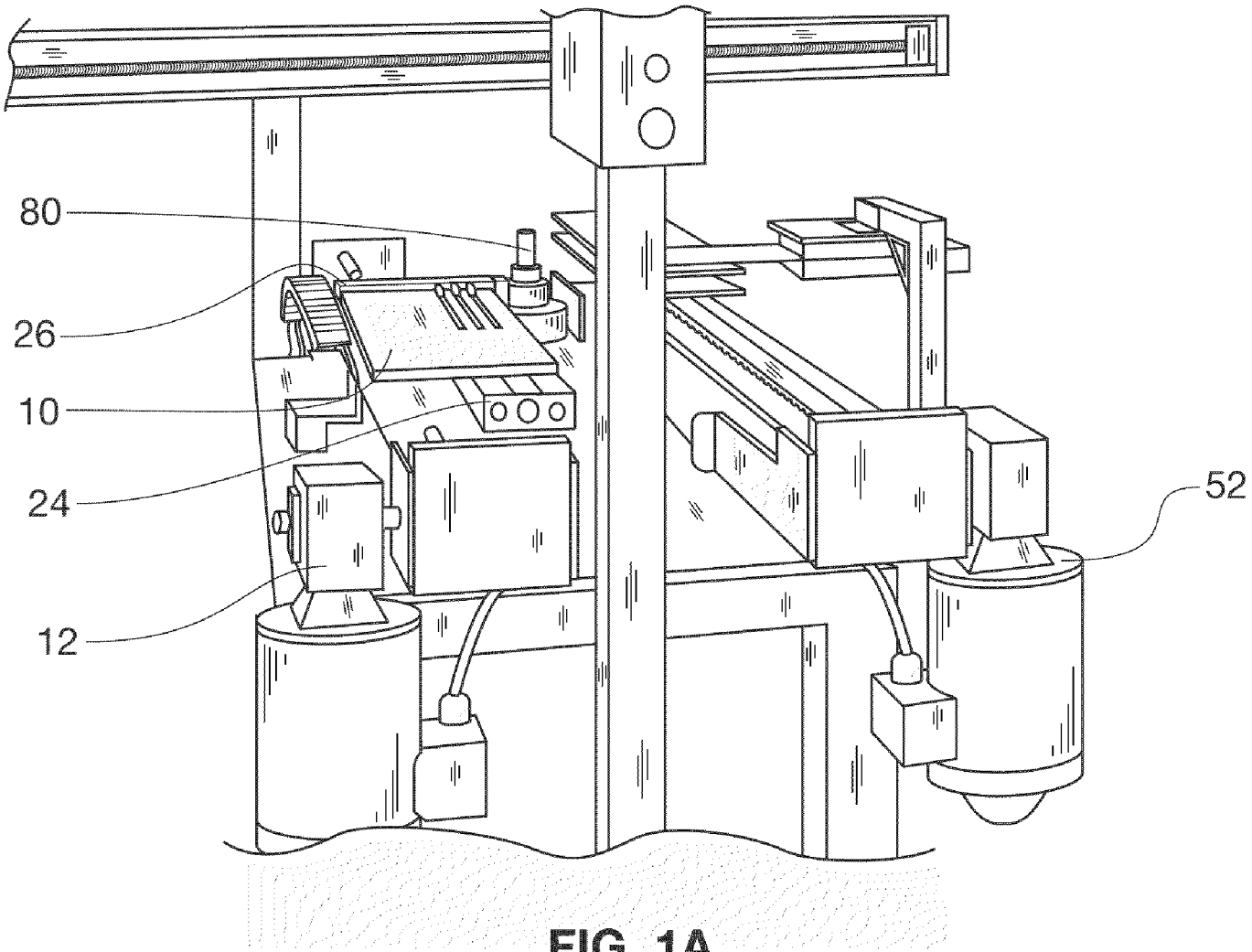

FIG. 1 and FIG. 1*a* both show end perspective views of the apparatus in accordance with the invention, including an infeed carriage 10 to the left and an outfeed carriage 50 to the right, each driven by a respective motor 12, 52 along respective infeed and outfeed tracks. Across the back of the machine extends the drive mechanism 30 for the transverse carriage's gripper/clamp 32, including a servo motor 30 and a drive screw 36.

The arbor 80 can be seen in FIG. 1*a* between the infeed and outfeed carriages. The cutting head that mounts on arbor 80 is not shown.

Figure 2:
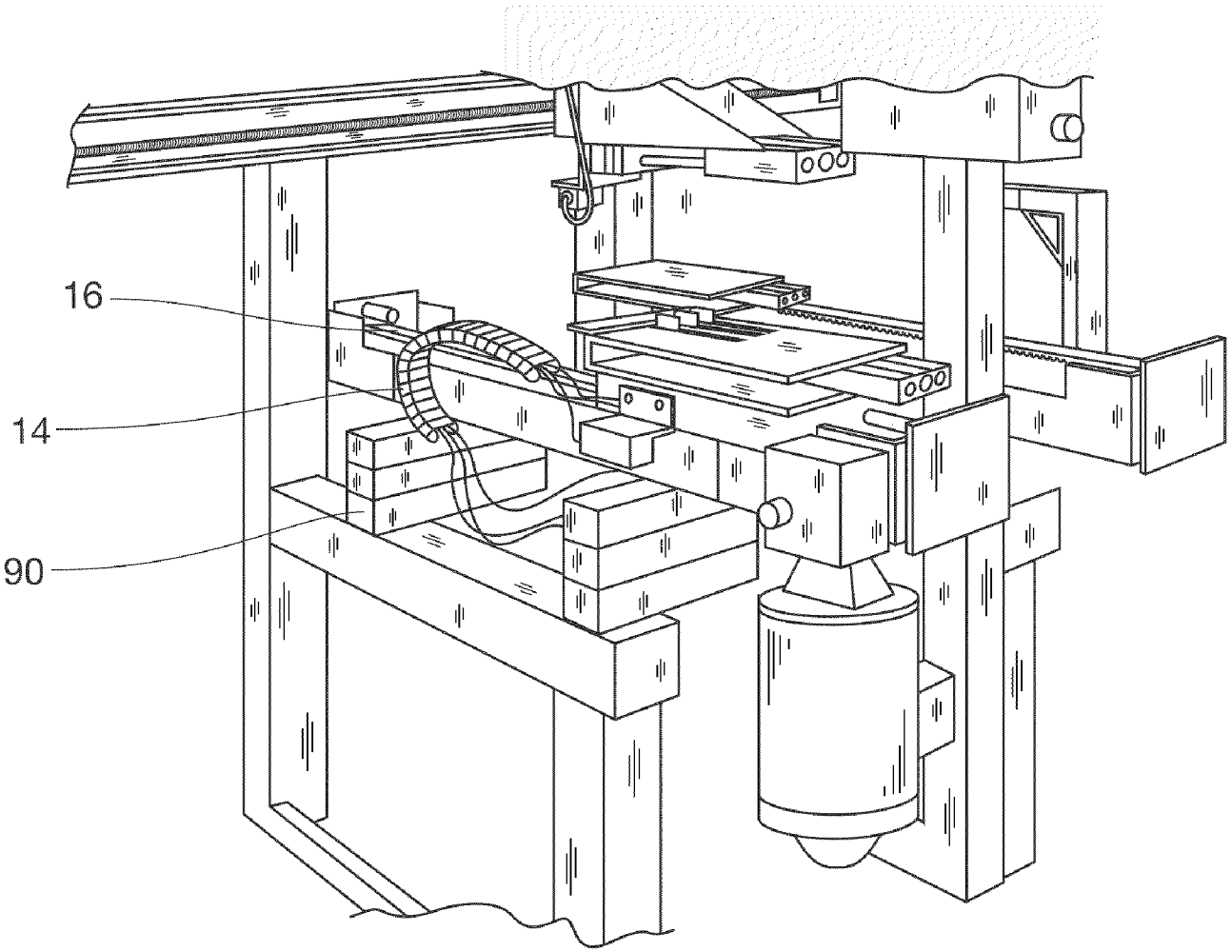
FIG. 2 is another perspective view of the apparatus from the infeed carriage end.

FIG. 2 is another perspective view of the apparatus from the infeed carriage end, showing a flexible cable tray 14 for control cables, as well as the drive mechanism 16 for the carriage along the infeed track. The drive mechanism can take the form of a toothed belt that is pulled in one direction or the other by the motor 12 and is affixed to the carriage 10, mounted on low friction bearings on frame 90.

Figure 3:
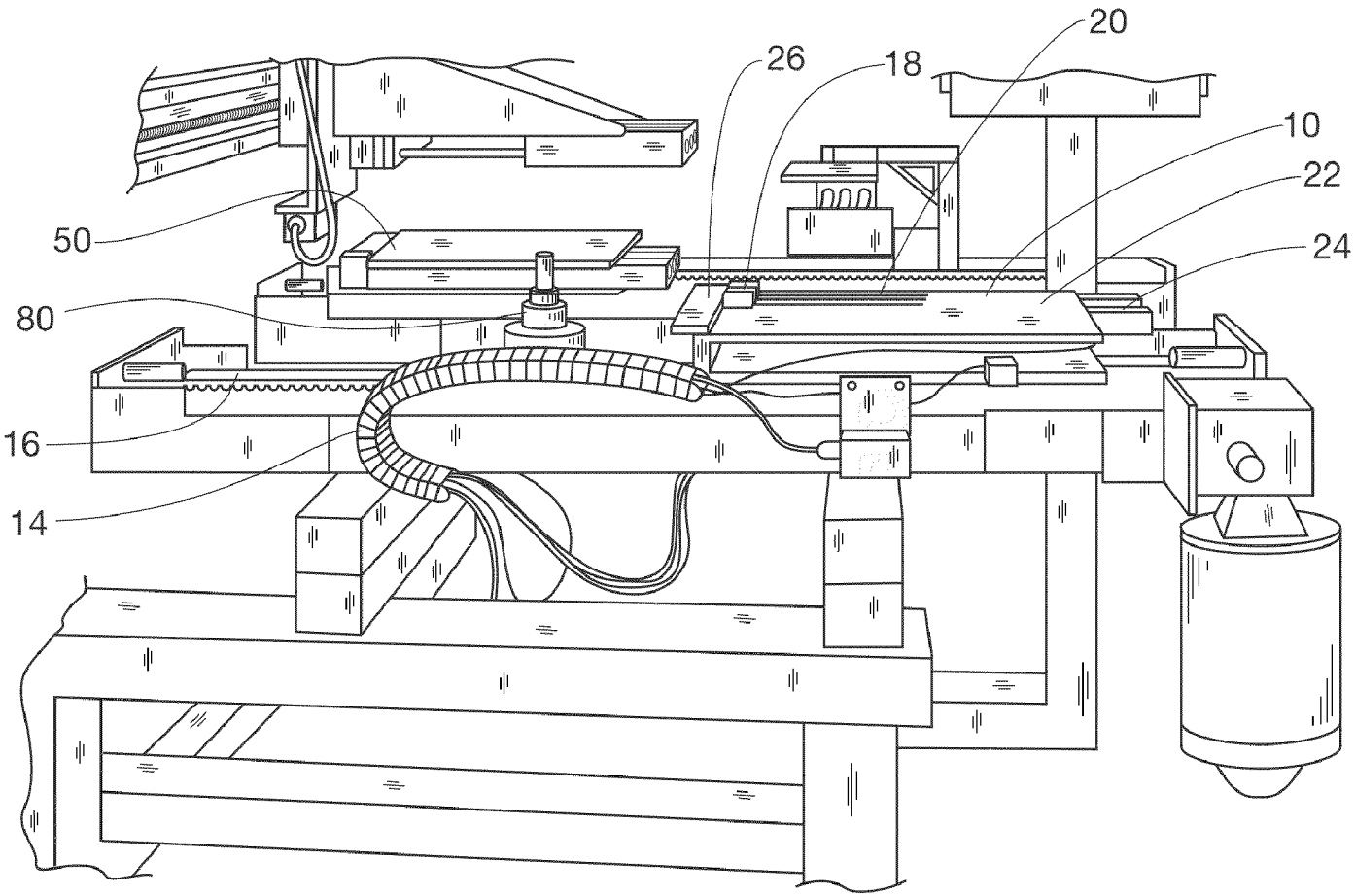
FIG. 3 shows a side perspective view of the infeed carriage.

FIG. 3 shows a side perspective view of the infeed carriage 10 having a series of clamping elements 18 which ride in slots 20 on a table 22 of the infeed carriage. These slidable elements 18 are commonly driven by a pneumatic cylinder 24 to clamp the work piece against a fence 26. Also visible in this view is the arbor 80 which receives the rotary cutting element. The outfeed carriage 50 is visible beyond the arbor. The rotatable cutting element on the arbor thus can cut each end of the work piece as it travels on one of the carriages past the cutting element on the arbor 80. In the view of FIG. 3, one end is cut as the infeed carriage 10 moves to the left, and the other end is cut as the outfeed carriage 50 is moved to the right.

Figure 4:
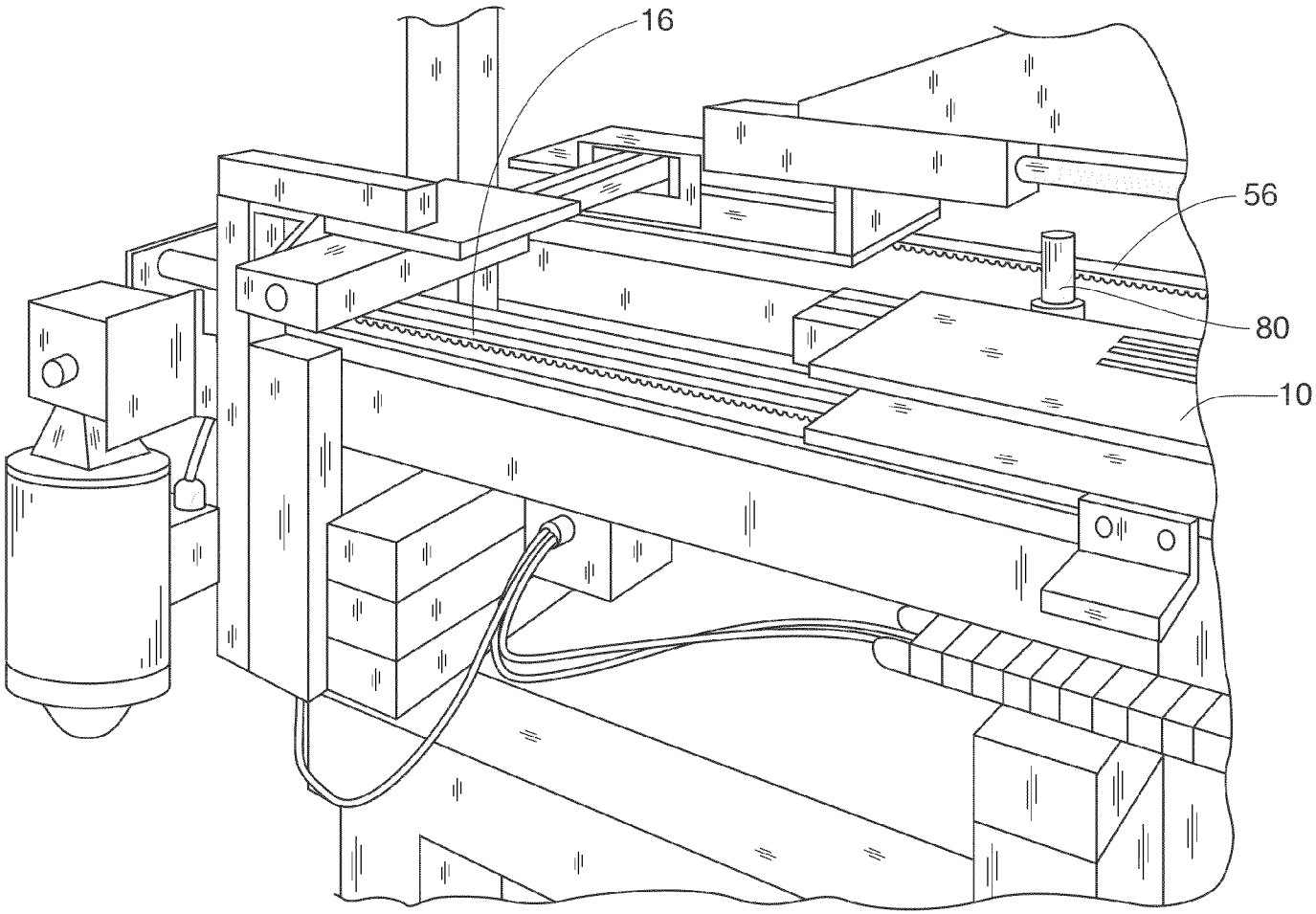
FIG. 4 shows the infeed carriage position alongside the arbor.

FIG. 4 shows the infeed carriage position alongside the arbor. Also visible in this view are the drive belts 16, 56 for driving the infeed and outfeed carriages, respectively.

Figure 4A:
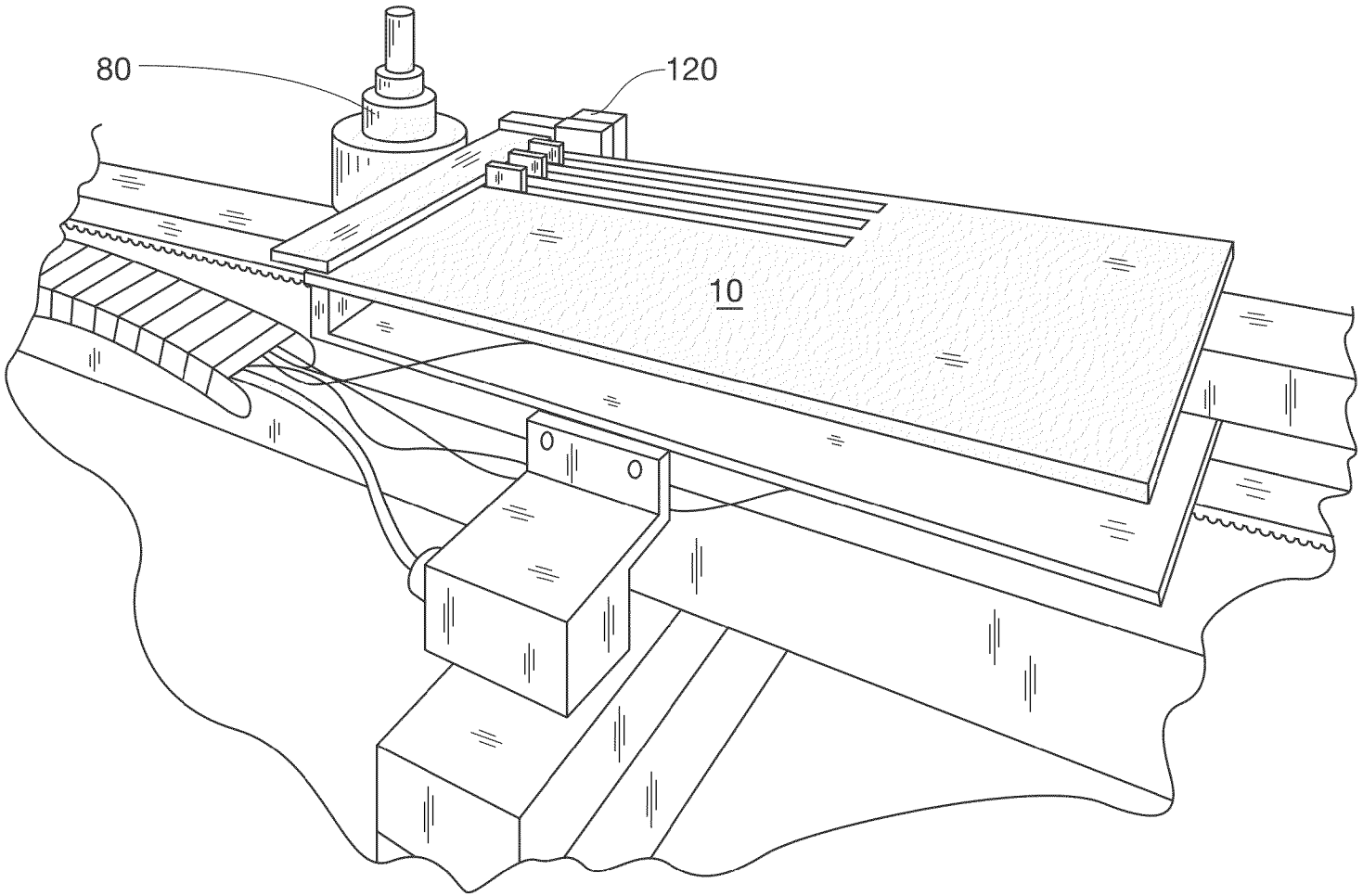
FIG. 4*a* shows the infeed carriage approaching the arbor.

FIG. 4*a* shows the infeed carriage approaching the arbor.

Figure 5:
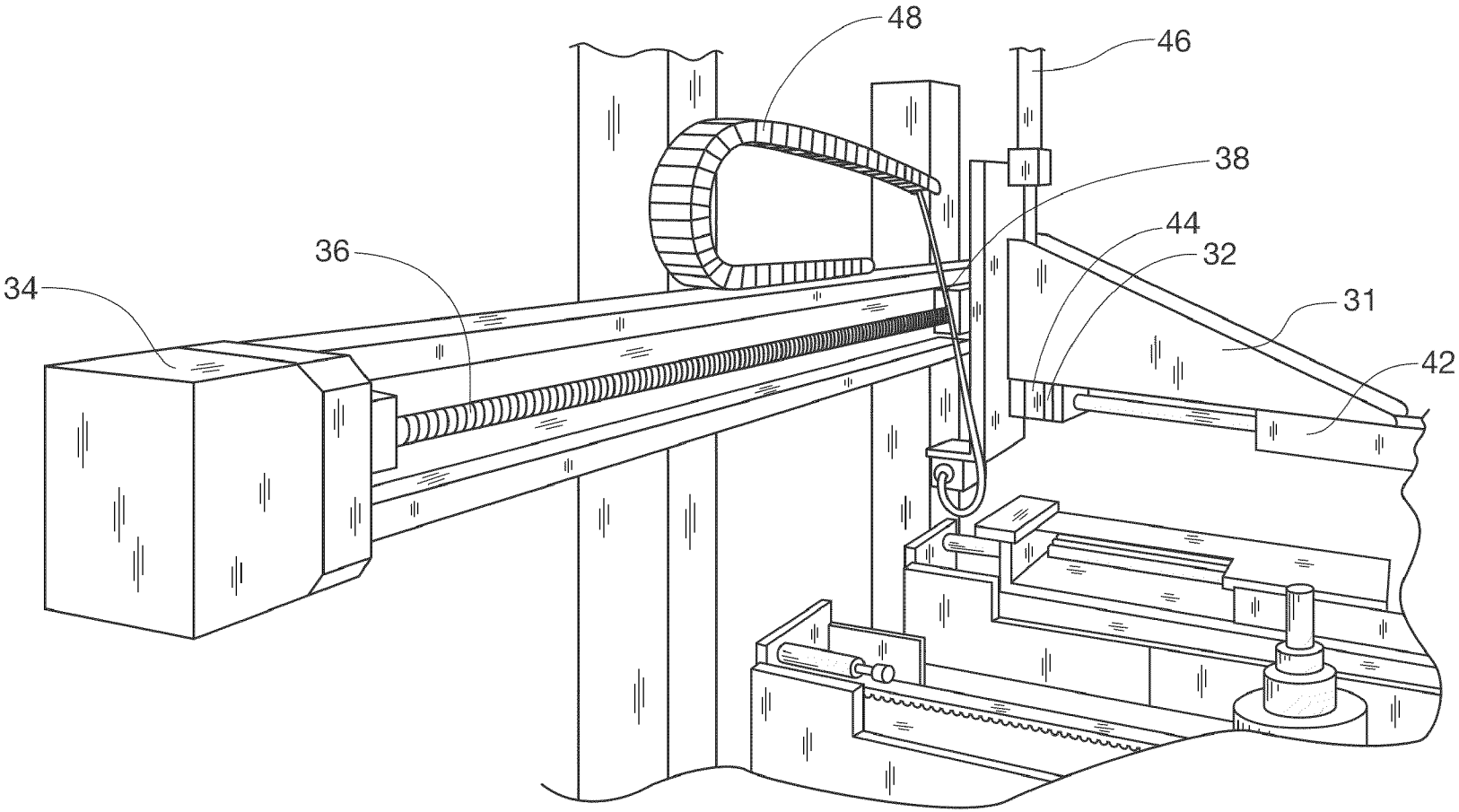
FIG. 5 shows the lateral transfer area including a transverse carriage and its gripper clamp.

FIG. 5 shows the lateral transfer area including a transverse carriage 31 and its gripper clamp 32 which move the work piece laterally from the infeed carriage to the outfeed carriage. The transverse carriage 31 is driven by a stepper motor 34 which rotates the threaded shaft 36 in a bearing 38 on the transverse carriage 31. Rotation in one direction thus drives the carriage 31 in one direction, and rotation in the other direction returns the carriage 31. The transverse carriage 31 has a cantilever support 40 holding a pneumatic ram 42 which cooperates with a stop 44 on the transverse carriage 31 to clamp the work piece for transfer from the infeed carriage to the outfeed carriage. The cantilevered support 40 is vertically movable on the carriage by a sliding bearing mounting and a pneumatic clamping cylinder 46. Control cables for the carriage 31 are housed in a flexible cable tray 48.

Figure 6:
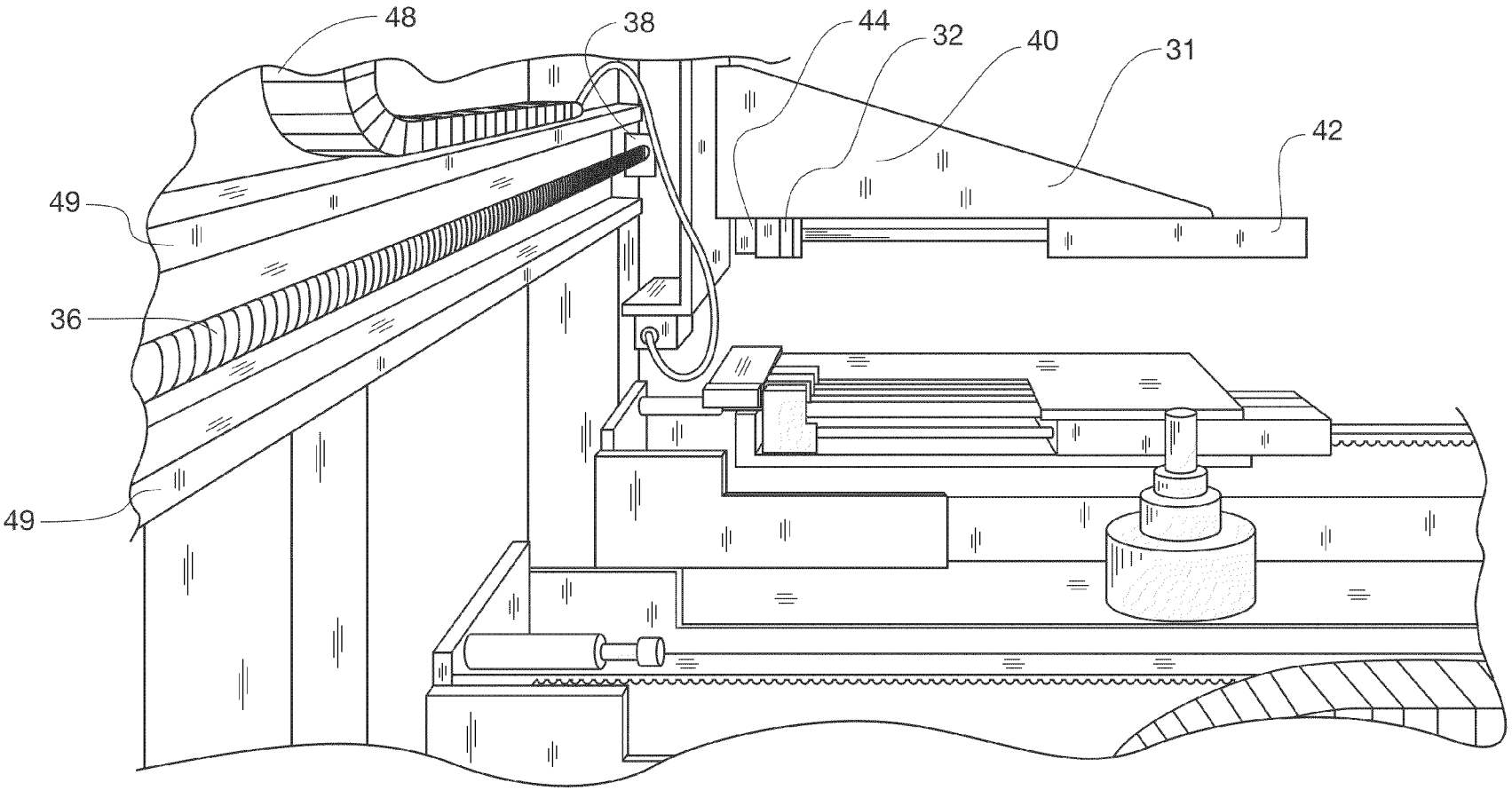
FIG. 6 shows the clamp on the transverse carriage.

FIG. 6 similarly shows the clamp on the transverse carriage. This figure also shows the bearing 38 of the transverse carriage driven by the threaded shaft 36, as well as rails 49 on which the transverse carriage rides to reduce friction.

Figure 7:
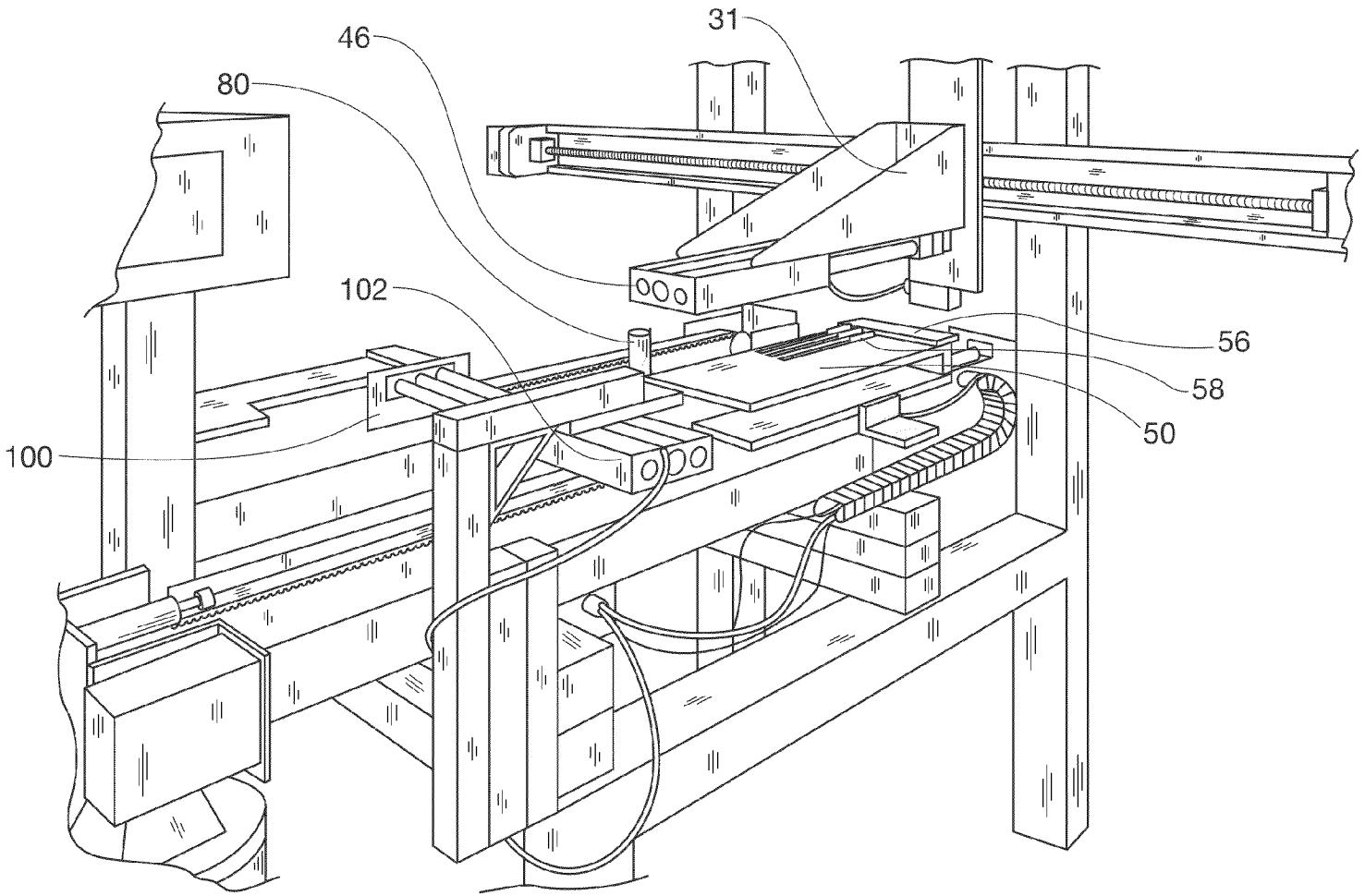
FIG. 7 is a view of the apparatus from the outfeed carriage side, also showing the transverse carriage, and its clamping cylinder.

FIG. 7 is a view of the apparatus from the outfeed carriage side, also showing the transverse carriage 31, and its clamping cylinder 46. The outfeed carriage 50 is very similar to the infeed carriage 10 and has clamping elements 58 which bear against a fence 56, driven by pneumatic cylinders (not visible in FIG. 7). The outfeed carriage 50 receives the work piece from the transverse carriage 31 and pulls the work piece past the arbor 80 to cut the other end. At a stop position, the clamping cylinder opens the clamp on the work piece, and a rake 100 on the end of the pistons of pneumatic cylinders 102 pulls the work piece to the right in the view of FIG. 7. From there, the work piece can drop onto a conveyor or other receptacle, not shown.

Figure 8:
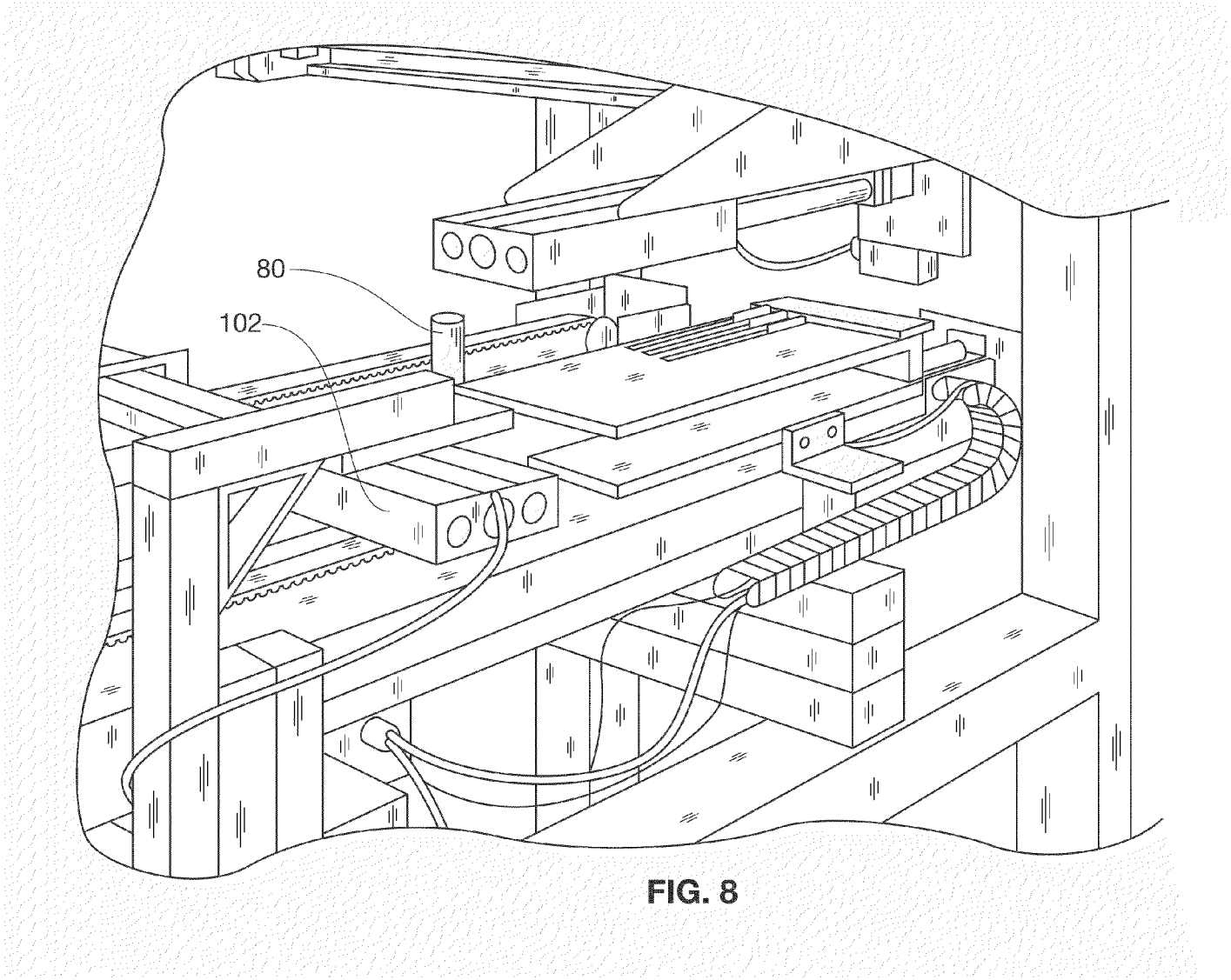
FIG. 8 shows another view of the outfeed carriage.

FIG. 8 shows another view of the outfeed carriage.

Figure 9:
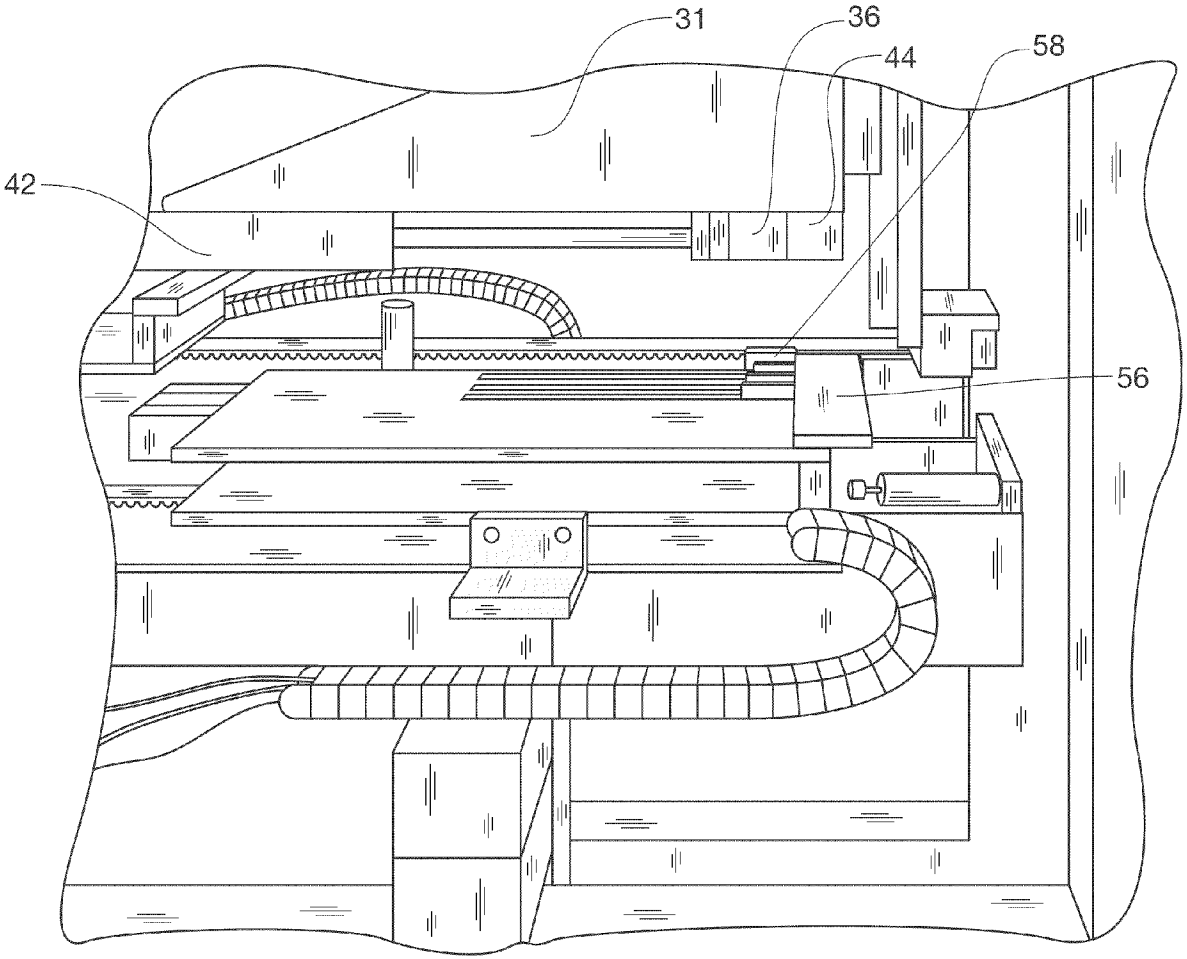
FIG. 9 shows yet another view of the outfeed carriage, particularly showing the clamping elements of the transverse carriage immediately above the clamping elements of the outfeed carriage.

FIG. 9 shows yet another view of the outfeed carriage, particularly showing the clamping elements of the transverse carriage immediately above the clamping elements of the outfeed carriage.

A computer or programmable logic controller is programmed with control signals to actuate the respective motors, drive cylinders, and the like, in the sequence required to operate as set forth herein.

In operation, a worker places a work piece on the infeed carriage 10. A sensor or the worker actuates a switch to close the clamps 18 on the work piece, with one end of the work piece against a fence (not shown) between the infeed and outfeed carriages or other end-positioning mechanism. The clamped work piece is then automatically carried toward the transverse carriage, carrying the positioned end past the arbor 80, where it is cut with the desired profile and with a predetermined position. At the end of travel of the infeed carriage, the transverse carriage 31 lowers, so that it is two clamping elements 32, 44 straddle the work piece and then close upon the tops of the side edges work of the piece to grasp it. The clamps of the infeed carriage 10 open. The work piece is lifted by the transverse carriage, and the infeed carriage 10 returns to pick up another work piece.

The transverse carriage 31 travels a pre-determined distance towards the outfeed carriage 50. This pre-determined distance is controlled by the computer in accordance with the requirements for the length of the finished work piece. Then, the transverse carriage 31 lowers the work piece onto the outfeed carriage 50, where it is clamped by the clamps 56, 58 of the outfeed carriage and released by the clamps of the transverse carriage. The transverse carriage then returns to pick up another piece from the infeed carriage.

The outfeed carriage 50 then moves away from the transverse carriage with the work piece grasped at the predetermined position along its length, so that as the work piece travels past the cutting element on the arbor 80, the second end of the work piece is carefully cut to length and profiled with the desired profile.

When the work piece travels to the point where the rake 100 is positioned, the clamps 56, 58 of the outfeed carriage open, and the rake 100 is actuated to the right to push the work off of the outfeed carriage. The outfeed carriage is then returned to the position near the transverse carriage to receive a next work piece and the rake returns to its central location.

As can be seen, the work piece length remains generally parallel with the path of the transverse carriage throughout processing. The desired final lengths of the work pieces can vary, without machine set up conversions to accommodate such variations.

Figure 10:
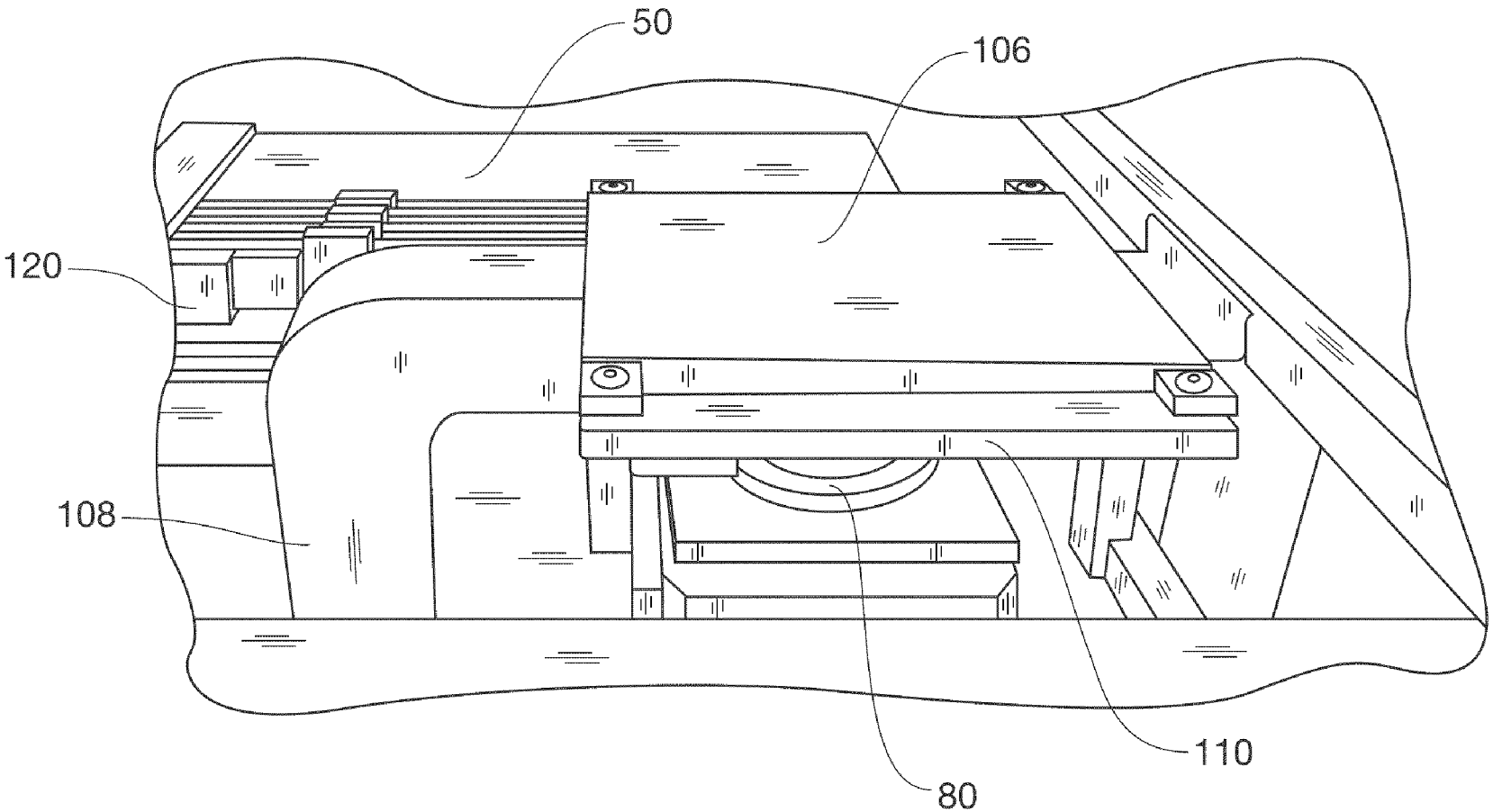
FIG. 10 shows a pressure shoe mounted over the arbor to hold the workpiece flat against the infeed and outfeed carriages.

Additional features can be included. For example, as seen in FIG. 10, a top pressure shoe 106 can help make sure the parts are flat going through the cutter. The shoe 106 is supported on a post 108 and extends toward both the infeed and outfeed carriages to hold down the end of the work piece being presented to the cutter on the arbor 80. The pressure shoe 106 includes a plate 110 that is biased downwardly into resilient compression on top of a passing work piece. Alternatively, two separate shoes could be used, one for the infeed and one for the outfeed. Also, an automatic transfer apparatus such as a conveyor can be included to take the parts discharged from the outfeed carriage and into a lineal profiler or other downstream processing.

A particularly useful improvement is seen in FIG. 4A and FIG. 10. Plastic pieces 120 are inserted into the portions of the clamps of the infeed and out feed tables that are closest to the cutter. The plastic pieces 120 act as a backer support to prevent the cross-grain of the wood from splintering out as the cutter is exiting the wood. One plastic piece 120 is mounted into the infeed table in the moveable element closest to the cutter, as seen in FIG. 4A. The other plastic piece is mounted in the fence of the outfeed table facing the cutter. In each of these positions the plastic piece bears against the workpiece from behind the workpiece as it enters the cutter. In an initial pass, the plastic insert is cut by the cutter to match the profile of the cutter and thereafter matches the profile of the workpiece being cut. When the cutter is changed to enable forming a different profile, the plastic pieces are removed and replaced with plastic pieces for the new profile. Removed plastic pieces can be reinserted when the profile is again used in the future. As a result, a set of profiled "backer blocks" can be accumulated, a pair for each profile. The blocks are mounted in such a way to facilitate quick and precise insertion and removal for fast changeover, such as by being held in place with a set screw.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for cutting rail ends for cabinet doors comprising a frame movably supporting an infeed carriage, a transverse carriage and an outfeed carriage, the infeed carriage and outfeed carriage being reciprocally moveable along infeed and outfeed tracks that are spaced apart and substantially parallel to one another, and the transverse carriage being reciprocally moveable from the infeed track to the outfeed track, above the infeed and outfeed carriages, an arbor positioned between the infeed track and the outfeed track and configured to receive, support and rotate a cutter, and clamps on the carriages to selectively clamp a workpiece to the respective carriages, whereby a workpiece can be clamped to the infeed carriage, carried along the infeed track past the arbor to cut an end of the workpiece, released from the infeed carriage and clamped by the transverse carriage, carried a desired distance towards the outfeed carriage, clamped to the outfeed carriage, carried along the outfeed track past the arbor to cut a second end of the workpiece, and released from the outfeed carriage.

2. An apparatus as claimed in claim 1 wherein the frame supports the transverse carriage for motion of the clamp of the transverse carriage to a first location that is further from the outfeed track than the spacing of the outfeed track from the infeed track and to a second location that is further from the infeed track than the spacing of the infeed track to the outfeed track, so that the clamp of the transverse carriage can clamp a midportion of a workpiece that has a length greater than twice the distance from the infeed track to the arbor.

3. An apparatus as claimed in claim 2 wherein the frame supports a rotating ball-screw threaded shaft driven by a servo motor to move the transverse carriage reciprocally from the first location to the second location.

4. An apparatus as claimed in claim 1 wherein each of the clamps grasps a workpiece from two opposing sides in the direction of motion of the infeed carriage.

5. An apparatus as claimed in claim 1 wherein the transverse carriage lifts the workpiece from the infeed carriage, transports the workpiece at a height above the arbor and lowers the workpiece to the outfeed carriage.

6. An apparatus as claimed in claim 1 further comprising a pressure shoe mounted over the arbor to hold the workpiece flat against the infeed and outfeed carriages as the workpiece is carried along the infeed track past the arbor.

7. An apparatus as claimed in claim 1 wherein the infeed track has an origin upstream of the arbor and further comprising an abutment between the infeed and outfeed tracks adjacent the origin of the infeed track for abutting placement of the end of a workpiece that is to be cut by the cutter on the infeed carriage.

8. An apparatus as claimed in claim 1 wherein the outfeed track has a terminus downstream of the arbor and further comprising a rake positioned at the terminus to push the work piece from the outfeed carriage.

9. An apparatus as claimed in claim 1 wherein the transverse carriage has a cantilevered support holding a pneumatic ram which cooperates with a stop on the transverse carriage to clamp the work piece for transfer from the infeed carriage to the outfeed carriage.

10. An apparatus as claimed in claim 9 wherein the cantilevered support is vertically movable on the transverse carriage by a sliding bearing mounting and a pneumatic cylinder.

11. An apparatus as claimed in claim 1 wherein the infeed carriage has a table with a fence, a plurality of clamping elements which ride in slots on the table of the infeed carriage, and a ram that commonly drives the elements to clamp the work piece against the fence.

12. An apparatus as claimed in claim 1 wherein the clamps on the carriages to selectively clamp a workpiece to the respective carriages are of a profile about one half of a height of an expected workpiece, so that at least instantaneously a workpiece can be simultaneously clamped to both the infeed carriage and the transverse carriage, or both the transverse carriage and the outfeed carriage.

13. An apparatus for cutting rail ends for cabinet doors comprising a frame movably supporting an infeed carriage, a transverse carriage and an outfeed carriage, the infeed carriage and outfeed carriage being reciprocally moveable along infeed and outfeed tracks that are spaced apart and substantially parallel to one another, and the transverse carriage being reciprocally moveable from the infeed track to the outfeed track, an arbor disposed between the infeed track and the outfeed track configured to receive, support and rotate a cutter, clamps on the carriages to selectively clamp a workpiece to the respective carriages, wherein each of the clamps grasps a workpiece from two opposing sides in the direction of motion of the infeed carriage and the clamps are of a profile about one half of a height of an expected workpiece, so that at least instantaneously a workpiece can be simultaneously clamped to both the infeed carriage and the transverse carriage, or both the transverse carriage and the outfeed carriage, wherein the infeed track has an origin upstream of the arbor and further comprising an abutment between the infeed and outfeed tracks adjacent the origin of the infeed track for abutting placement of the end of a workpiece that is to be cut on the infeed carriage and the outfeed track has a terminus downstream of the arbor and further comprising a rake positioned at the terminus to push the work piece from the outfeed carriage;

whereby a workpiece can be clamped to the infeed carriage, carried along the infeed track past the arbor to cut an end of the workpiece, released from the infeed carriage and clamped by the transverse carriage, carried a desired distance towards the outfeed carriage, clamped to the outfeed carriage, carried along the outfeed track past the arbor to cut a second end of the workpiece, and released from the outfeed carriage, wherein the frame supports a rotating ball-screw threaded shaft driven by a servo motor to move the transverse carriage reciprocally for motion of the clamp of the transverse carriage to a first location that is further from the outfeed track than the spacing of the outfeed track from the infeed track and to a second location that is further from the infeed track than the spacing of the infeed track to the outfeed track, so that the clamp of the transverse carriage can clamp a midportion of a workpiece that has a length greater than twice the distance from the infeed track to the arbor, and wherein the transverse carriage has a cantilevered support for the clamp of the transverse carriage, the cantilevered support holding a pneumatic ram which cooperates with a stop on the transverse carriage to clamp the work piece for transfer from the infeed carriage to the outfeed carriage and the cantilevered support is vertically movable on the transverse carriage by a sliding bearing mounting and a pneumatic cylinder so that the transverse carriage lifts the workpiece from the infeed carriage, transports the workpiece at a height above the arbor and lowers the workpiece to the outfeed carriage.

* * * * *